US011612534B2

(12) United States Patent
Ortega et al.

(10) Patent No.: US 11,612,534 B2
(45) Date of Patent: Mar. 28, 2023

(54) SURGERY PATIENT SUPPORT DEVICE

(71) Applicants: Sandra E. Ortega, Enid, OK (US); Douglas J. Wade, Enid, OK (US)

(72) Inventors: Sandra E. Ortega, Enid, OK (US); Douglas J. Wade, Enid, OK (US)

( * ) Notice: Subject to any disclaimer, the term of this patent is extended or adjusted under 35 U.S.C. 154(b) by 259 days.

(21) Appl. No.: 16/687,818

(22) Filed: Nov. 19, 2019

(65) Prior Publication Data

US 2021/0145683 A1 May 20, 2021

(51) Int. Cl.
*A61G 13/00* (2006.01)
*A61G 13/12* (2006.01)

(52) U.S. Cl.
CPC ..... *A61G 13/121* (2013.01); *A61G 13/122* (2013.01); *A61G 13/1235* (2013.01)

(58) Field of Classification Search
CPC ..... A61G 13/1205; A61G 13/121; A61G 13/122; A61G 13/1225; A61G 13/1255; A61G 13/1235; A61G 13/124; A61G 13/126; A61G 13/128; A61G 13/1285; A61G 13/129; A61G 13/1295; A61G 7/07; A61G 7/072; A61G 7/075; A61G 7/1082; A61G 7/1084; A61G 7/1086; A61G 7/1088; A61G 7/1092; A47G 9/1045; A47G 9/1054; A47G 9/1063; A47G 9/109; A47G 2009/1018
USPC ..... 128/845
See application file for complete search history.

(56) References Cited

U.S. PATENT DOCUMENTS

| | | | | |
|---|---|---|---|---|
| 2,782,427 | A * | 2/1957 | Ericson | A47G 9/10 5/632 |
| 4,235,472 | A * | 11/1980 | Sparks | A45C 9/00 108/43 |
| 5,269,035 | A * | 12/1993 | Hartunian | A47C 20/026 5/637 |
| 5,479,667 | A * | 1/1996 | Nelson | A47C 20/027 5/639 |
| 6,581,229 | B2 * | 6/2003 | Bernstein | A47C 20/025 5/631 |
| 8,069,515 | B1 * | 12/2011 | Tingey | A47C 20/023 5/632 |
| 8,516,639 | B2 * | 8/2013 | Mobley | A61G 13/121 5/640 |
| 2004/0123392 | A1 * | 7/2004 | Stewart, III | A47C 20/027 5/632 |

* cited by examiner

*Primary Examiner* — Adam Baker

(57) ABSTRACT

A surgery patient support device supports a surgery patient's head, neck, arms and torso while in a supine position, specifically the left or right lateral decubitus position. The device includes a support. The support has a main section and is constructed of a compressible foam. An elongated arm void extends into a first side of the main section of the support such that the void is configured to receive an upper arm of a patient therein while a head, a neck, and at least part of a torso of the patient is positioned on the support.

17 Claims, 7 Drawing Sheets

SURGERY PATIENT SUPPORT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to support devices and more particularly pertains to a new support device for supporting a surgery patient's head, neck, arms and torso while in a supine position, specifically the left or right lateral decubitus position.

(2) DESCRIPTION OF RELATED ART INCLUDING INFORMATION DISCLOSED UNDER 37 CFR 1.97 AND 1.98

The prior art relates to devices used to support a patient during a surgical procedure. Generally, these devices are positioned under a patient who is under a general anesthetic to support the patient in a position facilitating the surgical procedure.

BRIEF SUMMARY OF THE INVENTION

An embodiment of the disclosure meets the needs presented above by generally comprising a support. The support has a main section and is constructed of a compressible foam. An elongated arm void extends into a first side of the main section of the support such that the void is configured to receive an upper arm of a patient therein while a head, a neck, and at least part of a torso of the patient is positioned on the support.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
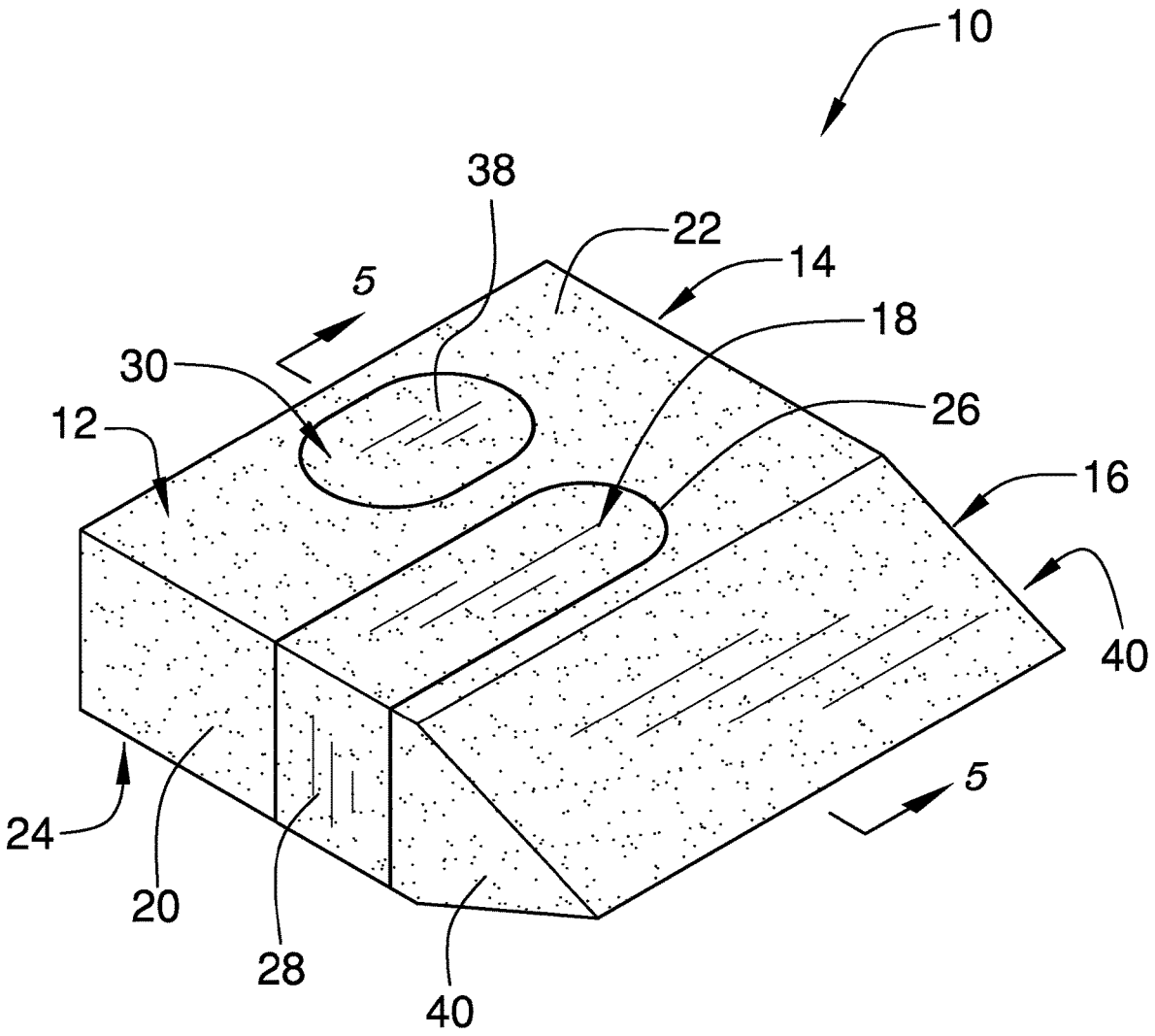
FIG. 1 is a top front side perspective view of a surgery support device according to an embodiment of the disclosure.
Figure 2:
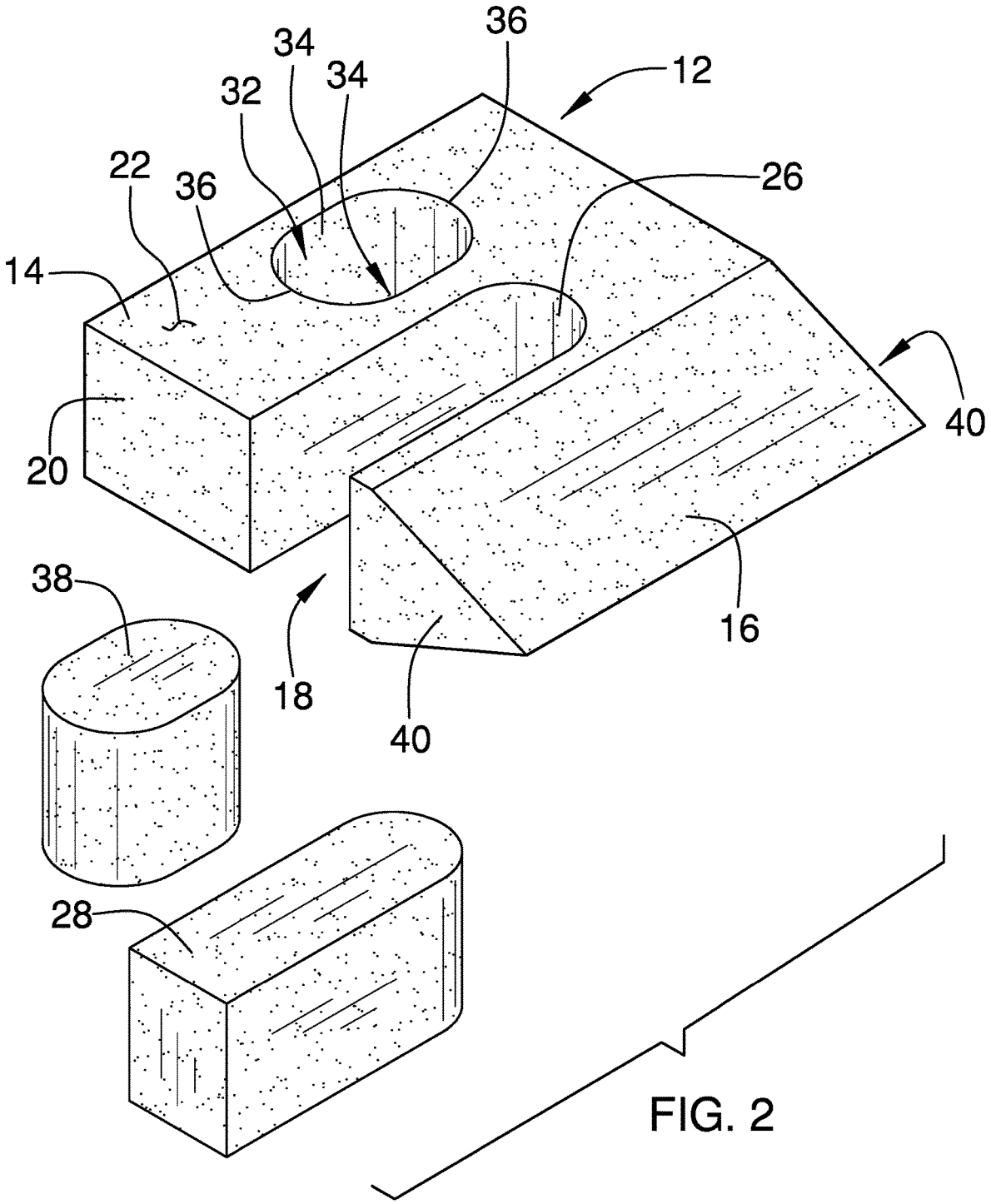
FIG. 2 is a top front side perspective view of an embodiment of the disclosure.
Figure 3:
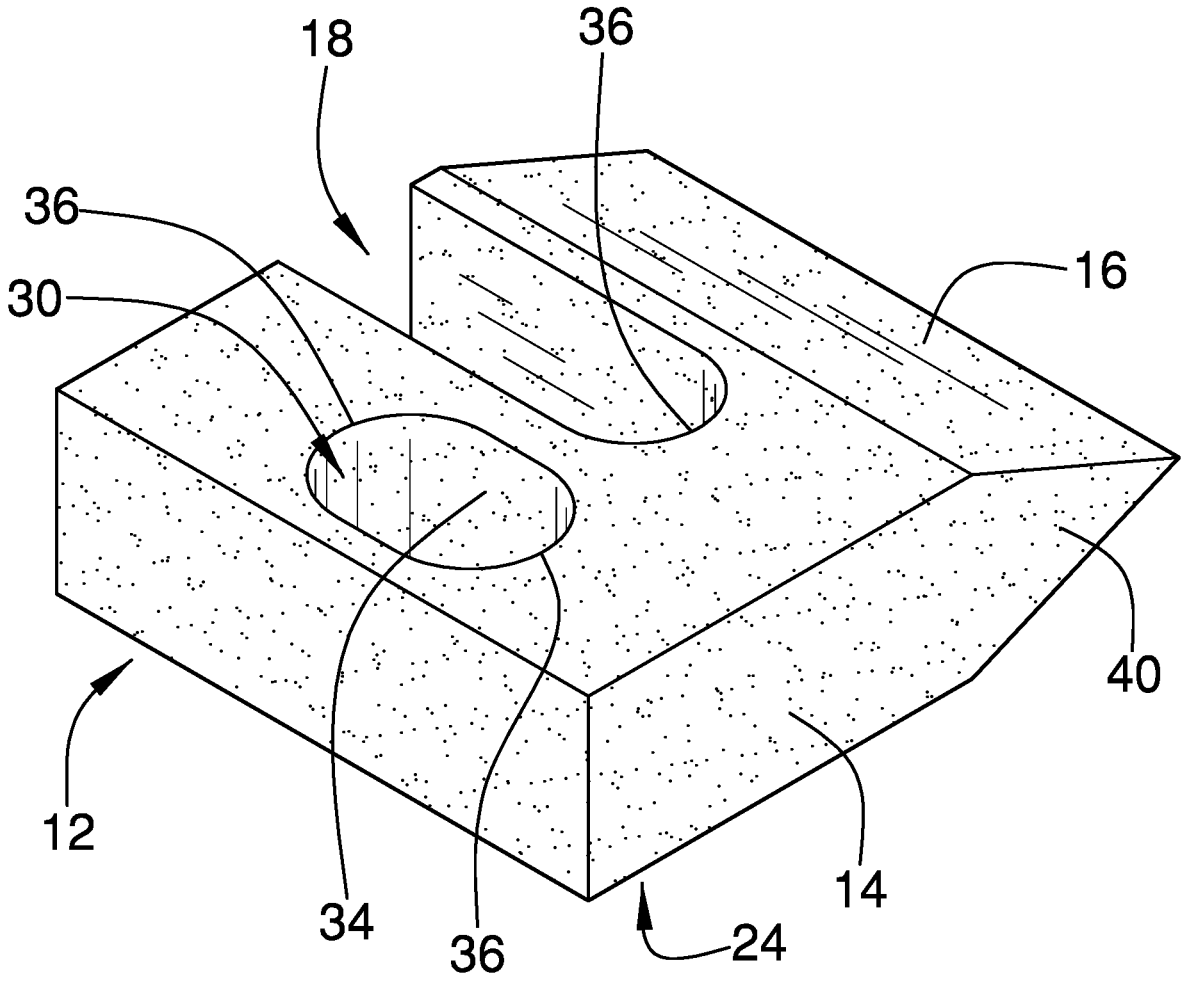
FIG. 3 is a partial top front side perspective view of an embodiment of the disclosure with inserts removed.
Figure 4:
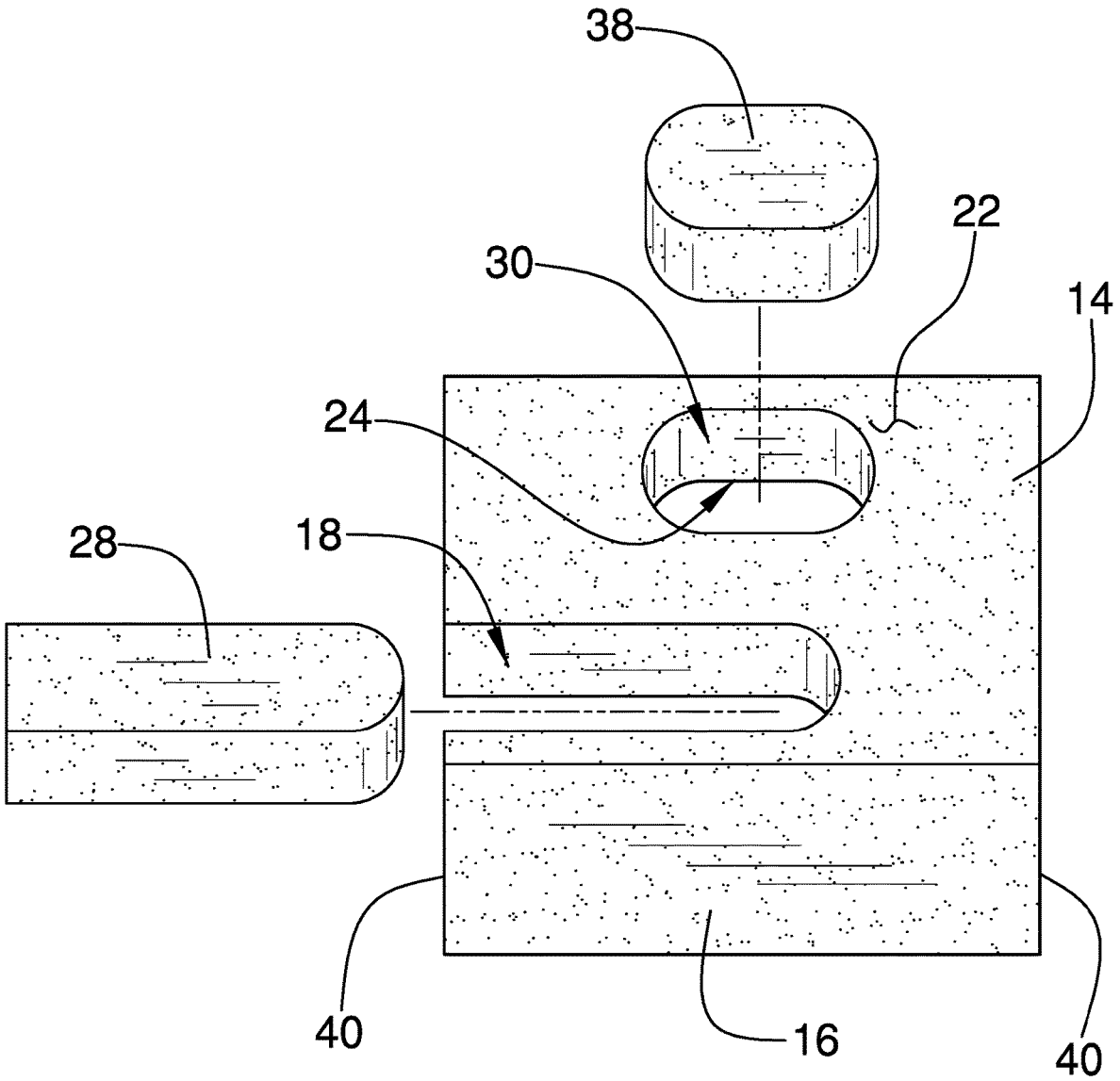
FIG. 4 is a top front side perspective view of an embodiment of the disclosure before removal of inserts.
Figure 5:
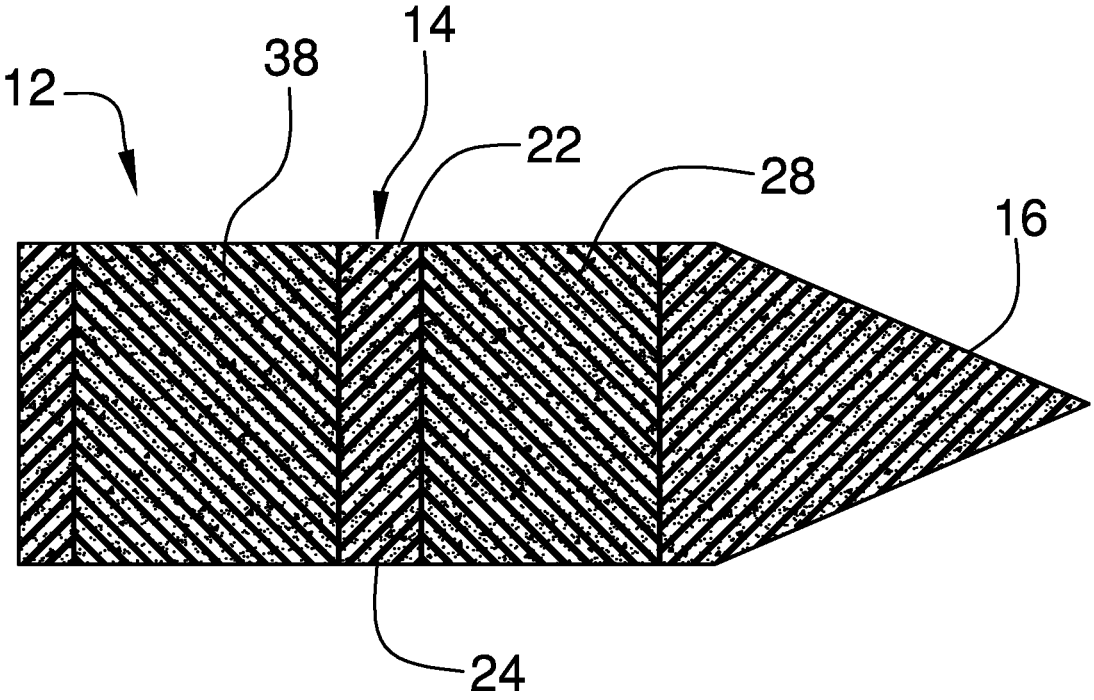
FIG. 5 is a side view of an embodiment of the disclosure in use.
Figure 6:
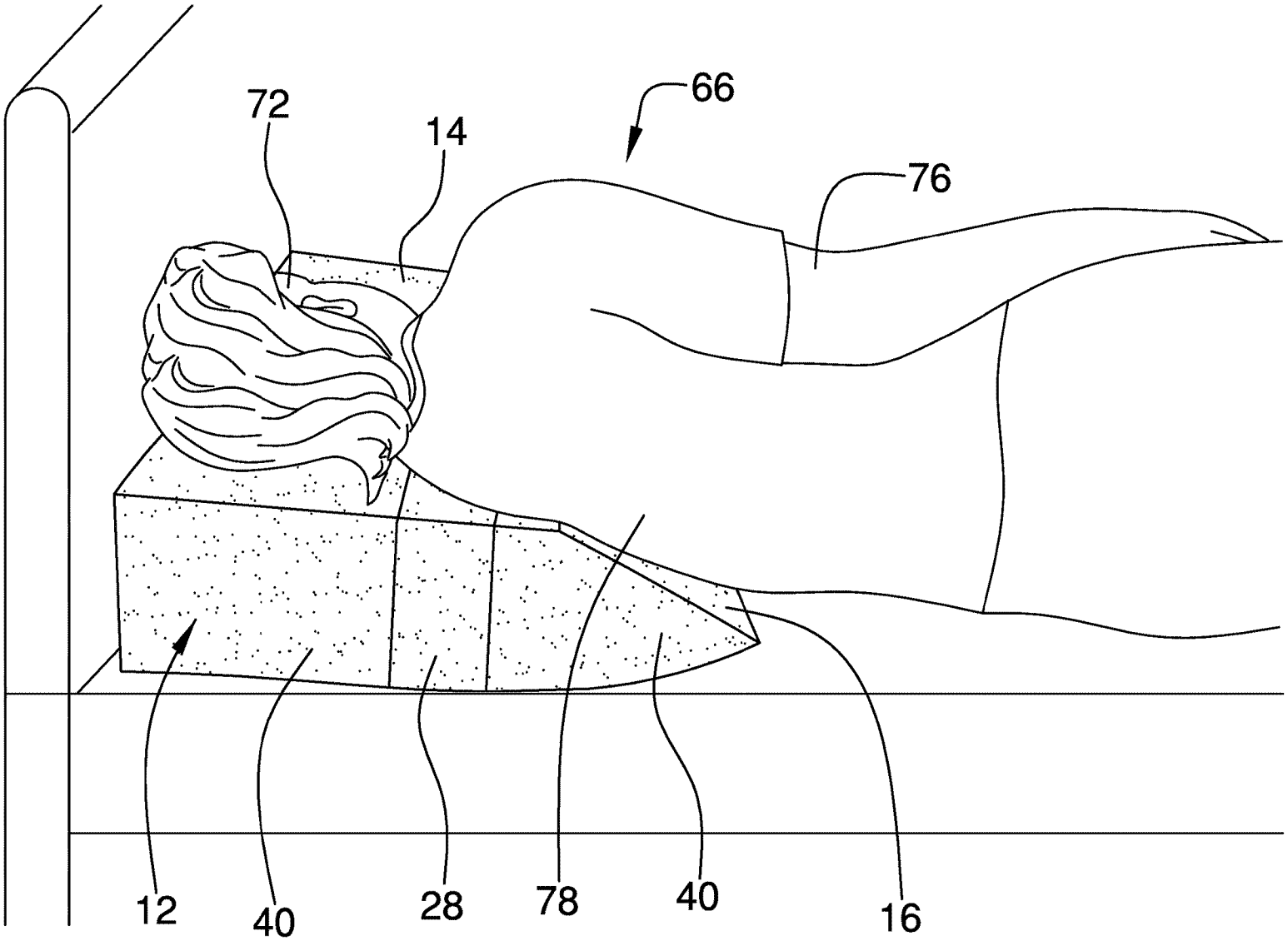
FIG. 6 is a side view of an embodiment of the disclosure.
Figure 7:
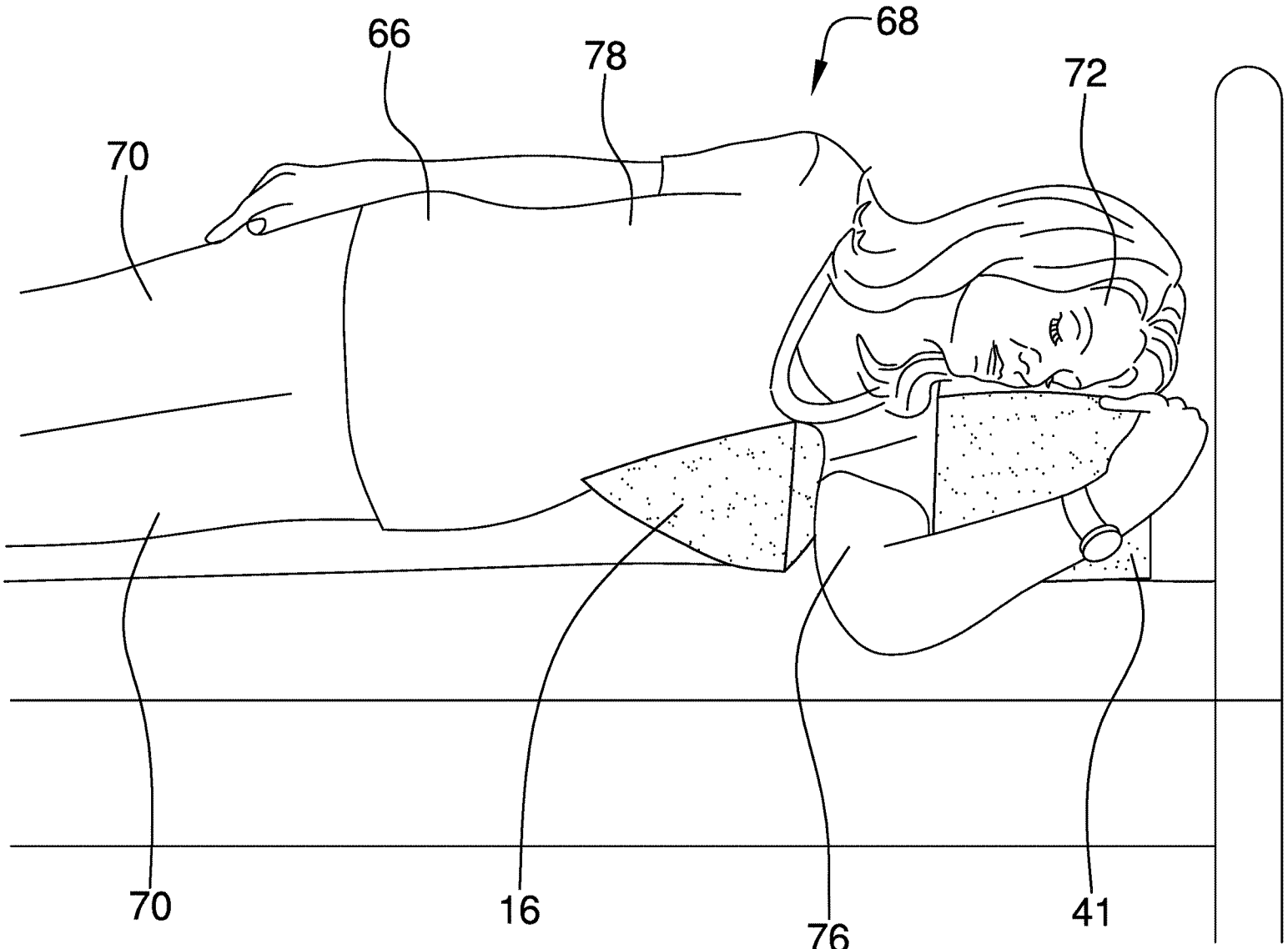
FIG. 7 is a side view of an embodiment of the disclosure in use.

With reference now to the drawings, and in particular to FIGS. 1 through 7 thereof, a new surgery patient support device embodying the principles and concepts of an embodiment of the disclosure and generally designated by the reference numeral 10 will be described.

As best illustrated in FIGS. 1 through 7, the surgery patient support device 10 generally comprises a support 12. The support 12 has a main section 14 and may include a prismatic extension 16. The main section 14 is a parallelepiped. The support 12 is constructed of a compressible material such as foam or similar material. The material may be a single use disposable type or otherwise being capable of being sterilized for repeated use in a surgical field. An elongated arm void 18 extends into a first side 20 of the main section 14 of the support 12. The arm void 18 extends fully between a topmost surface 22 of the support 12 and a bottommost surface 24 of the support 12. The arm void 18 extends perpendicularly relative to the first side 20 of the support 12. The arm void 18 defines an arcuate distal surface 26 relative to the first side 20 of the support. An arm void insert 28 is also constructed of compressible material such as foam or the like. The arm void insert 28 is complementary in shape to the arm void 18 wherein the arm void insert 28 is positionable to occupy the arm void 18.

A head void 30 extends through the support 12. The head void 30 extends through the support 12 between the topmost surface 22 and the bottommost surface 24. The head void 30 defines a channel 32 extending fully through the support 12. The head void 30 defines a pair of straight longitudinal planar surfaces 34 parallel to each other and perpendicular to the first side 20 of the support 12. The head void 30 also defines a pair of curved end surfaces 36 at opposite ends of the longitudinal planar surfaces 34. A head void insert 38 is complementary in shape to the head void 30 wherein the head void insert 38 is positionable to occupy the head void 30. The head void insert 38 is constructed of compressible material such as foam or the like.

Each of the arm void insert 28 and the head void insert 38 may be created by being cut directly out of the support 12. Each of the arm void insert 28 and head void insert 38 may be positioned between body parts of the patient where cushioning is desirable while a patient 66 is in a lateral decubitus position 68. For example, either of the arm void insert 28 and the head void insert 38 may be positioned between legs 70 of the patient 66 to provide separation or cushioning between knees or ankles of the patient 66.

The support 12 may include the prismatic extension 16 extending from the main section 14. The prismatic extension 16 has isosceles triangular end faces 40 which may be parallel to each other or angled. The prismatic extension 16 may be an integral extension of the main section 14. The prismatic extension 16 is elongated and perpendicular to the first side 20 of the support 12.

The support 12 is symmetrical relative to a central plane parallel to the topmost surface 22 and the bottommost surface 24 wherein the support 12 may be inverted to properly support the patient 66 lying on either a left or right side.

The device 10 is used to assist in positioning and supporting the patient 66 when placed in the lateral decubitus position 68. The device 10 will support a head 72, a neck 74, and at least a portion of a torso 78 of the patient 66 when the patient 66 is in the left or right lateral decubitus position. The device 10 is placed at a head of a surgical bed with the prismatic extension 16 being directed toward a foot of the surgical bed. The head void insert 38 is removed prior to the patient 66 lying or being positioned on the device 10. The head void 30 will allow for the positioning of a side of the head 72 of the patient 66 when in the lateral decubitus position 68. Removal of the head void insert 38 also provides for pressure free positioning of the downwardly facing ear and side of the face. Alternatively, the head void insert 38 may be left in the head void 30 to alter the position of the head 72 depending on desired flexion or extension of the neck 74 of the patient 66. Prior to turning the patient 66 to the lateral decubitus position 68 the arm void insert 28 is removed. The arm void 18 will then receive an upper section 80 of a downwardly positioned arm 76 and allow support for the torso 78 of the patient 66 by the main section 14 and prismatic extension 16 of the support 12. Proper positioning of the support 12 under the patient 66 prior to turning the patient 66 into the lateral decubitus position 68 allows the downwardly positioned arm 76 to move into the arm void 18 as the patient 66 is turned. Thus, the patient 66 need not be lifted for proper positioning. The arm void 18 is placed toward the right for right lateral decubitus positioning and to the left for left lateral decubitus positioning.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A surgery support device comprising:

a support, the support having a main section and a prismatic extension coupled to and extending from the main section, the main section being a parallelepiped, the support being compressible; and an elongated arm void extending into a first side of the main section of the support such that the arm void is configured to receive an upper section of an arm of a patient therein while a head, a neck, and at least part of a torso of the patient is positioned on the support, the arm void extending fully and perpendicularly between a topmost surface of the support and a bottommost surface of the support along a full length of the arm void, the arm void extending into the main section of the support greater than half a width of the main section, the arm void extending into the main section adjacent to the prismatic extension.

2. The surgery support device of claim 1, further comprising the arm void extending perpendicularly into the support relative to the first side of the main section of the support.

3. The surgery support device of claim 1, further comprising the arm void defining an arcuate distal surface relative to the first side of the main section of the support.

4. The surgery support device of claim 1, further comprising an arm void insert being complementary in shape to the arm void, the arm void insert being removably insertable into the arm void such that the arm void insert occupies the arm void.

5. The surgery support device of claim 4, further comprising the arm void insert being compressible.

6. The surgery support device of claim 1, further comprising a head void extending into the support.

7. The surgery support device of claim 6, further comprising the head void extending into the main section of the support.

8. The surgery support device of claim 6, further comprising the head void defining a channel extending fully through the support.

9. The surgery support device of claim 6, further comprising the head void defining a pair of straight longitudinal planar surfaces parallel to each other and perpendicular to the first side of the main section of the support.

10. The surgery support device of claim 9, further comprising the head void defining a pair of curved end surfaces at opposite ends of the longitudinal planar surfaces.

11. The surgery support device of claim 6, further comprising a head void insert being complementary in shape to the head void, the head void insert being removably insertable into the head void such that the head void insert occupies the head void.

12. The surgery support device of claim 11, further comprising the head void insert being compressible.

13. The surgery support device of claim 1, further comprising the prismatic extension having isosceles triangular end faces, the end faces being parallel to each other.

14. The surgery support device of claim 1, further comprising the prismatic extension having isosceles triangular end faces, the end faces being angled relative to each other such that the prismatic extension tapers extending away from the main section.

15. The surgery support device of claim 1, further comprising the prismatic extension being elongated and perpendicular to the first side of the main section of the support.

16. The surgery support device of claim 1, further comprising the support being symmetrical relative to a central plane parallel to the topmost surface of the support and the bottommost surface of the support.

17. A surgery support device comprising:

a support, the support having a main section, the support being compressible, the main section being a parallelepiped, the support including a prismatic extension being coupled to and extending from the main section of the support, the prismatic extension being elongated and perpendicular to a first side of the main section of the support, the prismatic extension having isosceles triangular end faces, the end faces being parallel to each other, the support being symmetrical relative to a central plane parallel to a topmost surface of the main section and a bottommost surface of the main section;

an elongated arm void extending into the first side of the main section of the support such that the arm void is configured to receive an upper section of an arm of a patient therein while a head, a neck, and at least part of a torso of the patient is positioned on the support, the arm void extending fully and perpendicularly between the topmost surface of the main section and the bottommost surface of the main section along a full length of the arm void, the arm void extending perpendicularly into the support relative to the first side of the main section of the support, the arm void defining an arcuate distal surface relative to the first side of the main section of the support, the arm void extending into the main section of the support greater than half a width of the main section, the arm void extending into the main section adjacent to the prismatic extension;

an arm void insert being complementary in shape to the arm void, the arm void insert being removably insertable into the arm void such that the arm void insert occupies the arm void, the arm void insert being compressible;

a head void extending into the support, the head void extending into the main section of the support, the head void defining a channel extending fully through the support, the head void defining a pair of straight longitudinal planar surfaces parallel to each other and perpendicular to the first side of the main section of the support, the head void defining a pair of curved end surfaces at opposite ends of the longitudinal planar surfaces; and a head void insert being complementary in shape to the head void, the head void insert being removably insertable into the head void such that the head void insert occupies the head void, the head void insert being compressible.

* * * * *